US006499911B2

(12) United States Patent
Hilliard et al.

(10) Patent No.: US 6,499,911 B2
(45) Date of Patent: Dec. 31, 2002

(54) COMPLIANT POROUS GROIN AND SHORELINE RECLAMATION METHOD

(75) Inventors: Wallace J. Hilliard, Naples, FL (US); Lance D. Reich, Smyrna, GA (US)

(73) Assignee: Parker Beach Restoration, Inc, Naples, FL (US)

( * ) Notice: Subject to any disclaimer, the term of this patent is extended or adjusted under 35 U.S.C. 154(b) by 0 days.

(21) Appl. No.: 09/943,706

(22) Filed: Aug. 31, 2001

(65) Prior Publication Data

US 2002/0076282 A1 Jun. 20, 2002

(51) Int. Cl.[7] ..... E02B 3/06; E02B 3/04; E02B 3/18

(52) U.S. Cl. ..... 405/32; 405/52; 405/74; 405/302.6; 405/302.7; 256/1

(58) Field of Search ..... 405/15, 21, 28, 405/30, 32, 52, 74, 302.6, 302.7; 256/1, 12.5, 13

(56) References Cited

U.S. PATENT DOCUMENTS

| | | | | |
|---|---|---|---|---|
| 388,338 A | | 8/1888 | Bright | 405/35 |
| 449,185 A | | 3/1891 | Soloman | 405/32 |
| 1,716,509 A | | 6/1929 | Smith | 405/32 |
| 1,721,894 A | | 7/1929 | Abbe | 256/23 |
| 1,844,484 A | | 2/1932 | Smith | 405/32 |
| 1,906,442 A | | 5/1933 | Barras | 256/12.5 |
| 1,969,123 A | | 8/1934 | Doble | 405/32 |
| 2,097,342 A | | 10/1937 | Rehfeld | 405/34 |
| 2,135,337 A | | 11/1938 | Herbest | 405/32 |
| 2,341,515 A | | 2/1944 | Rehfeld | 405/32 |
| 3,564,853 A | | 2/1971 | Csiszar | 405/32 |
| 4,710,056 A | | 12/1987 | Parker | 405/15 |
| 5,720,573 A | | 2/1998 | Benedict et al. | 405/52 |
| 5,807,024 A | | 9/1998 | Benedict | 405/21 |
| 5,833,387 A | | 11/1998 | Tackney | 405/28 |
| 5,944,443 A | | 8/1999 | Benedict | 405/21 |
| 6,190,088 B1 | * | 2/2001 | Van Der Hidde et al. | 405/74 |
| 6,375,165 B1 | * | 4/2002 | Sherratt et al. | 256/1 |

FOREIGN PATENT DOCUMENTS

| | | |
|---|---|---|
| IT | 565640 | 12/1956 |

* cited by examiner

*Primary Examiner*—Thomas B. Will
*Assistant Examiner*—Tara L. Mayo
(74) *Attorney, Agent, or Firm*—Bockhop & Reich, LLP

(57) ABSTRACT

A compliant porous groin and method of use for restoring an eroding shoreline. The compliant porous groin has at least two supports placed in the eroding shoreline and a compliant porous barrier is attached to the supports such that the barrier is at least partially within a sediment-laden eroding water flow of the shoreline with the water flow passing through at least a portion of the barrier. The barrier is compliant such that the water flow impacting the barrier is slowed to at least a critical accretion velocity whereby sediment suspended in the water flow accretes to renourish the shoreline.

24 Claims, 5 Drawing Sheets

COMPLIANT POROUS GROIN AND SHORELINE RECLAMATION METHOD

BACKGROUND OF THE INVENTION

1. Field of the Invention

The present invention generally relates to apparatuses and methods to restore or prevent erosion of shorelines and beaches. More particularly, the present invention relates to an apparatus and method for shoreline reclamation that uses a plurality of stanchions and a compliant porous barrier fastened to the stanchions to create a temporary structure that is placed in the water flow, proximate to the shoreline, and the structure causes accretion of sediment suspended in the water flow.

2. Description of the Related Art

Shorelines on bodies of moving water, such as rivers and oceans, will erode from natural processes removing material from the shoreline. This erosive process is sometimes referred to as "scour," and the natural processes of movement of material along a coastal shoreline are referred to as littoral processes. In scour, the moving water suspends the material at one location in the flowing water and then redeposits the material at some other location. Many factors specific to the particular shoreline and water velocities can enhance the erosion phenomenon.

One significant factor is the consistency of the material comprising the shoreline. A sandy beach is easily eroded by a slow and steady stream of water, and can be quickly eroded in very turbulent and fast moving water such as the seas associated with a major storm. Conversely, shoreline comprised of mostly rocks or larger sediment will be much less susceptible to erosion.

Another significant factor enhancing the erosion process is the velocity of the water passing across the shoreline. In order to initiate scour, the water must move at a velocity greater than a critical "suspension velocity" to suspend the sediment of the shoreline in the moving water. The suspension velocity required to initiate scour is dependent upon many location specific factors, such as the geometric shape of the shoreline, the average velocity of the water, the average direction of flow of the water in relation to the shoreline, the depth of the water, the density of the sediment material to be transported.

Shoreline erosion is a serious problem because most of the urban areas of the world are ports having urban development right up to the shoreline. There are often structural improvements present at and near the shoreline, such as private beach homes, hotels, bridges, retaining structures, and the like, and shoreline erosion progressively undermines the foundations thereof and threatens the physical integrity of the structures over time. There are also many regions with beach tourism as their main industry, and thus, beach erosion can cause these regions significant economic harm by removing the main tourist attraction.

There have been many devices and methods of hydraulic and earth engineering employed in the attempt to preserve shorelines or other areas subject to the erosive influence of moving water. The main method of combating erosion is to simply renourish an eroding beach with a fresh supply of dredged sand. This method has many problems associated with it however. The dredged sand often does not match the existing color of sand on the beach and diminishes the aesthetic appearance of the beach. The dredged sand can also contain rocks or other solid objects that can hinder water sports such as swimming or surfing, and can hurt the bare feet of waders upon the renourished beach.

Other methods to prevent shoreline erosion fortify the eroding shoreline with blocks, cement and the like so as to form a prophylactic layer over the region of the shoreline that would otherwise be subject to the erosive effects of the moving water. However, due to the weight and bulk of the fortifying materials, such "armoring" techniques are often difficult to install on the shoreline and adequately anchor the armor to the underlying shoreline, whether beach, bank or both. The armored structures often result in permanent structures that are not easily removed from the shoreline and prevent full enjoyment of the region of the shoreline that they overlay.

Jetties or groins are also known for attempting to control shoreline erosion. As is well known to those skilled in the art, each shoreline has a natural water direction and flow rate in accord with which it migrates. In the typical construction, a jetty of stone or other permanent formation is built into the shore so as to form a jetty traverse the natural flow direction of the shoreline. While the jetty has the advantageous effect of promoting local sediment deposition, the jetty has a distinct disadvantage in that it causes downstream and upstream erosion. And if too many jetties are installed along a given region of shoreline, the jetties may alter the dynamic equilibrium of the shoreline and undesirably change the shape of the beach as a whole, especially when the shoreline is subject to a significant erosive event such as a storm or flood.

There are other shore and bank protection techniques and devices known in the art that attempt to control erosion by attenuating the energy, velocity, and/or direction of a potentially erosive water flow with the use of temporary structures placed on the shoreline. Several of these devices are porous groins structures using either flexible or rigid nets, screens, or filters placed on the shoreline substantially perpendicularly to the shoreline and extending into the surf. The porous groins are placed in the tidal and longshore currents and function in much the same way as a jetty to cause sand to accrete around the porous groin. The porous groin must be constantly moved or removed from the accreting sand or else extreme force must be used to dislodge the porous groin from the accreted sediment.

Moreover, many of these structures cite their success in beach restoration as arising from the ability of the net, screen, or filter to trap larger sediment being pulled along the sea bottom to cause ridges to build-up at the base of the porous groin. However, these structures have also been used to successfully restore pure-sand beaches, i.e. where larger sediment, such as rocks, coral, shells, and the like are not significantly present in the sediment comprising the beach. Thus, the extant explanation for success of these devices is unsatisfactory given the success in restoration of pure-sand or sediment shorelines.

Accordingly, it would be advantageous to provide a device and method for shoreline restoration that uses temporary structures to renourish the beach taking full advantage of the correct mechanism for the accretion of sand and sediment from the eroding water flow. Such device and method should renourish the beach without adversely altering the surrounding shoreline. It is thus to such a shoreline reclamation device and method that the present invention is primarily directed.

SUMMARY OF THE INVENTION

The present inventive system and method provides a compliant porous groin for restoring an eroding shoreline utilizing the particular accretion mechanism for a water flow that contains suspended sediments. The water flow has a critical accretion velocity as it flows across the eroding shoreline, and if the water flow velocity is slower than a critical accretion velocity above which sediments otherwise remain suspended in the water flow, the suspended sediments will accrete from the water flow. The compliant porous groin takes advantage of this mechanism to renourish the sediment of an eroding shoreline, such as sand on a beach.

The compliant porous groin comprises at least two supports placed in the eroding shoreline with a compliant porous barrier attached to the supports such that the barrier is at least partially within the water flow of the shoreline and the water flow passes through at least a portion of the barrier. The supports are any rigid or semi-rigid structure that can support the barrier in the water flow, such as a stanchion, tripod, pole, or channel. The barrier is compliant such that the sediment-laden water flow impacting the solid portions of the barrier is slowed to at least the critical accretion velocity such that the sediment accretes from the water flow adjacent to the barrier.

The shoreline includes a beach portion that does not ordinarily have water upon it, a substantially water-covered portion, such as an inter-tidal region, and the water portion, generally below the low-tide line. The at least two supports can be placed entirely in the substantially water-covered portion, with at least one support in the beach portion and at least one support in the substantially water-covered portion, or with at least both supports in the water portion outside of the low-tide line.

The actual compliance of the barrier can be achieved through several methods. The barrier can be made of a rigid material, such as rigid plastic webbing or wire mesh, and be flexibly held to the support to be compliant to the impacting eroding water flow. Alternatively, the barrier can made of an elastic material, such as semi-rigid plastic webbing, a mesh (organic or polymer netting), or other interwoven series of members that are compliant to the impacting eroding water flow.

The invention further provides a method for restoring a shoreline having a eroding water flow moving at a velocity thereacross with suspended sediments therein and having a critical accretion velocity wherein the suspended sediments accrete from the water flow if the velocity of water flow is less than the critical accretion velocity, the method including the steps of placing at least two supports in the eroding shoreline, attaching a compliant porous barrier to the at least two supports such that the barrier is at least partially within the water flow of the shoreline and the water flow passes through at least a portion of the barrier, and accreting sediment from the water flow with the compliance of the barrier slowing the water flow impacting the barrier to at least the critical accretion velocity. The method preferably further includes the steps of lifting the barrier out from the accreting sediment as sediment accretes from the water flow to cover the barrier, and removing the barrier and supports from the shoreline after the shoreline has been renourished.

If the step of attaching a compliant porous barrier to the at least two supports is attaching a rigid porous barrier to the at least two supports such that the barrier is flexibly held to the at least two supports, then the step of accreting sediment from the water flow impacting the barrier is accreting sediment from the water flow impacting the rigid barrier made compliant to the impacting water flow from the flexible attachment of the barrier to the at least two supports, the compliance of the rigid barrier slowing the impacting water flow to at least the critical accretion velocity. And if the step of attaching a compliant porous barrier to the at least two supports is attaching an elastic porous barrier to the at least two supports, then the step of accreting sediment from the water flow impacting the barrier is accreting sediment from the water flow impacting the elastic barrier that is compliant to the impacting water flow from the elasticity of the barrier, the compliance of the elastic barrier slowing the impacting water flow to at least the critical accretion velocity.

The compliant porous groin thus advantageously performs shoreline restoration using the compliance of the barrier to effect the accretion of sand and sediment from an eroding water flow. The accretion can be optimized as the compliance of the barrier can be adjusted to specifically offset a given water flow such that the impacting sediment-laden water will be slowed to at least the critical accretion velocity. The compliant porous groin does not significantly interfere with the longshore transport such that its use adversely alters the shoreline surrounding the renourished area. Further, the compliant porous groin is a temporary structure that can be used to renourish the beach and be removed thereafter with almost no environmental impact. It is thus to such a shoreline reclamation device and method that the present invention is primarily directed.

Other objects, advantages, and features of the present invention will become apparent after review of the hereinafter set forth Brief Description of the Drawings, Detailed Description of the Invention, and the Claims

DETAILED DESCRIPTION OF THE INVENTION

Figure 1:
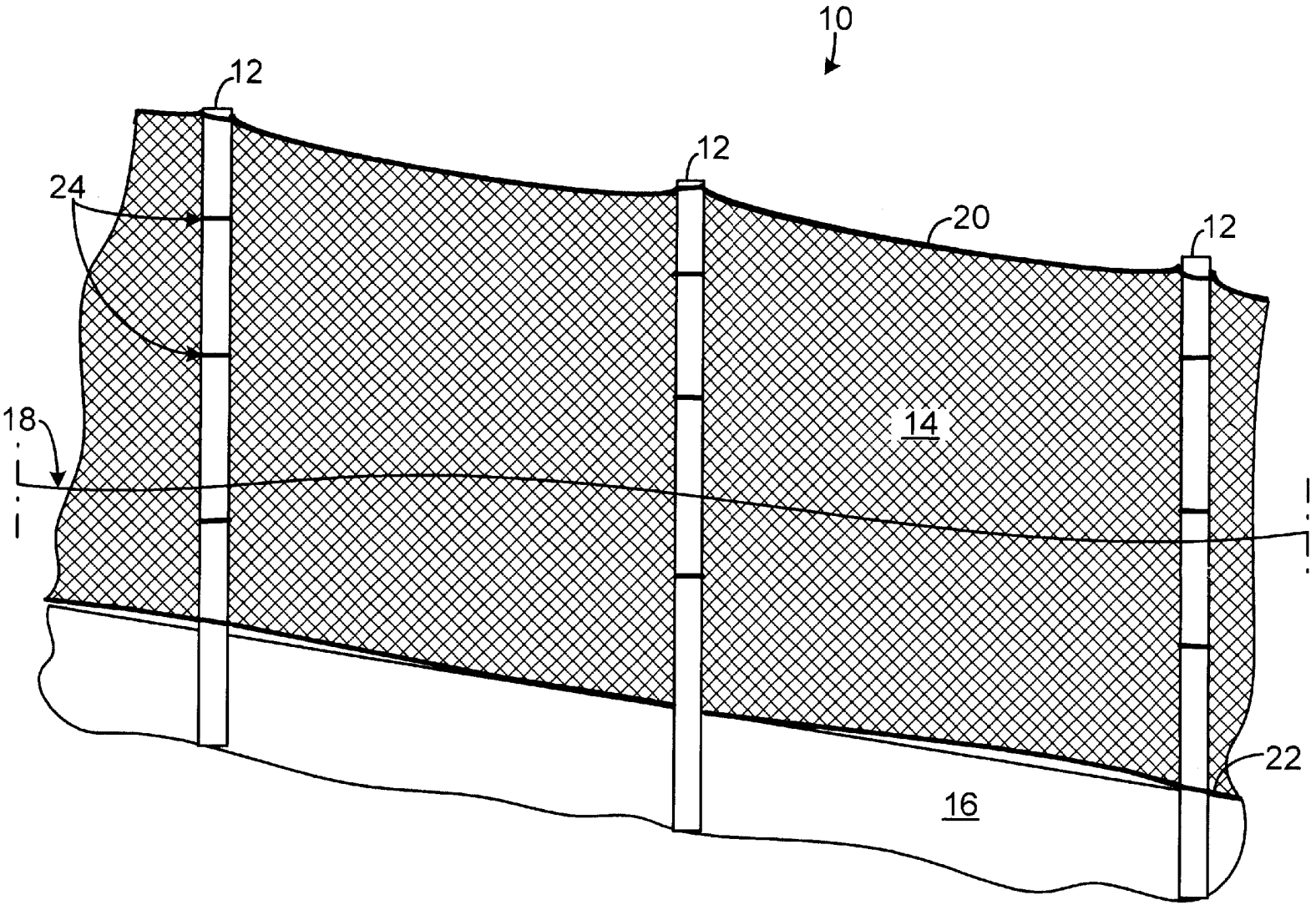
FIG. 1 is a side-perspective view of the apparatus for shoreline reclamation installed on a shoreline, and particularly illustrating the supports moored in the shoreline, and the supported compliant barrier partly within the water.

With reference to the figures in which like numerals represent like elements throughout, FIG. 1 is a side-perspective view of the compliant porous groin 10, with a plurality of supports 12 installed on a shoreline, shown here as a beach 16, with a water line 18. A compliant porous barrier 14 is attached to the supports 12 such that the barrier 14 is at least partially within the water flow, i.e. beneath water line 18, of the shoreline and the water flow passes through at least a portion of the barrier 14. As is further described herein, the barrier 14 is compliant such that the water flow impacting the barrier 14 is slowed to a critical accretion velocity wherein the water flow will accrete some of the sediment suspended therein.

The supports are preferably made of a rigid or semi-rigid material, such as a metal or a polymer plastic, and should be able to resist corrosive effects if used in a saltwater shoreline. The support 12 can be stanchion as is shown in FIG. 1, or can be other shapes and configurations such as tripods, poles, channels, or other supporting structures that are known in the art. The stanchions can be made of any rigid material such as Schedule 80 PVC, galvanized steel channels, or molded or cast polyethylene (PET). One preferred construction of the stanchions as supports 12 is the use of 2 lbs/ft galvanized, rib-back u-shaped channels that average 12 feet in length. If portions of lengths of stanchions are required, the channel can be cut in half or to any desired length. Further, it is also preferable that the top of each support 12 is preferably highly visible, and thus can be marked with international orange paint or other bright paint, and can also include a caution light preferably on the top of the end supports 12 to make the apparatus highly visible to boaters and beachgoers.

The barrier 14 is shown in FIG. 1 as an elastic mesh net suspended from a supporting line 20 interwoven through the upper loops of the net, and also has a weighted bottom edge 22, such as a metal cable, woven through the lower loops of the net such that the lower edge of the net substantially rests upon the sea bottom. The use of the supporting line 20 and weighted bottom edge 22 are not necessary if the net or barrier 14 is stretched taught between the supports 12. The barrier 14 is attached to the supports 12 by bands 24, which can be rigid fastener, such as rigid polymer locking loops as are known in the art, or can be more flexible fasteners made of an elastomeric material. Alternately, the barrier 14 can be attached to the supports 12 only at the supporting line 20 and weighted bottom edge 22, which are respectively attached to the supports 12, and the barrier 14 does not need to be otherwise attached to the supports 12 directly. The barrier 14 is made of an elastic material compliant to the impacting eroding water flow, such as a mesh net, which can be made from an organic material or plastic material such as nylon or other semi-rigid plastic webbing or mesh, or other interwoven series of members. Alternately, the barrier 14 can be made of a rigid material, such as a metal wire mesh, a rigid plastic webbing, or other inflexible interwoven or porous material which is flexibly held to the supports 12 with a flexible or elastomeric fastener, such as bands 24, such that the barrier 14 is compliant to the impacting eroding water flow from the flexing of the bands 24 or other flexible fastener rather than the compliance occurring from the actual elasticity of the barrier 14. A combination of both an elastic barrier 14 and flexible attaching fasteners of the barrier 14, such as bands 24, can be used to create a specific amount of compliance of the barrier 14 for a given critical accretion velocity of a water flow.

The elastic webbing comprising the barrier 14 in FIG. 1 is preferably made from a flexible material, such as nylon, and can have various sizes of meshes, depending upon the sediment grain size and other factors specific to the shoreline. Various colors of webbing 14 can also be used according to existing factors at a project location, such as brackishness of water and indigenous wildlife populations. The barrier 14 can be attached to the supports 12 in individual segments or alternately, one contiguous barrier 14 can be connected to supports 12 at various points in the length of the barrier 14.

If the supports 12 are stanchions installed into the shoreline and sea-bottom through known methods such as jet-pumping or mechanical driving, the stanchions are preferably installed to an approximate depth of 50% of overall length, and can be installed deeper if required due to a significant anticipated load from the surf. Other types of supports, such as tripods, are more inherently stable and do not need to be deeply embedded into the shoreline and sea-bottom in order to anchor the groin 10.

Figure 2:
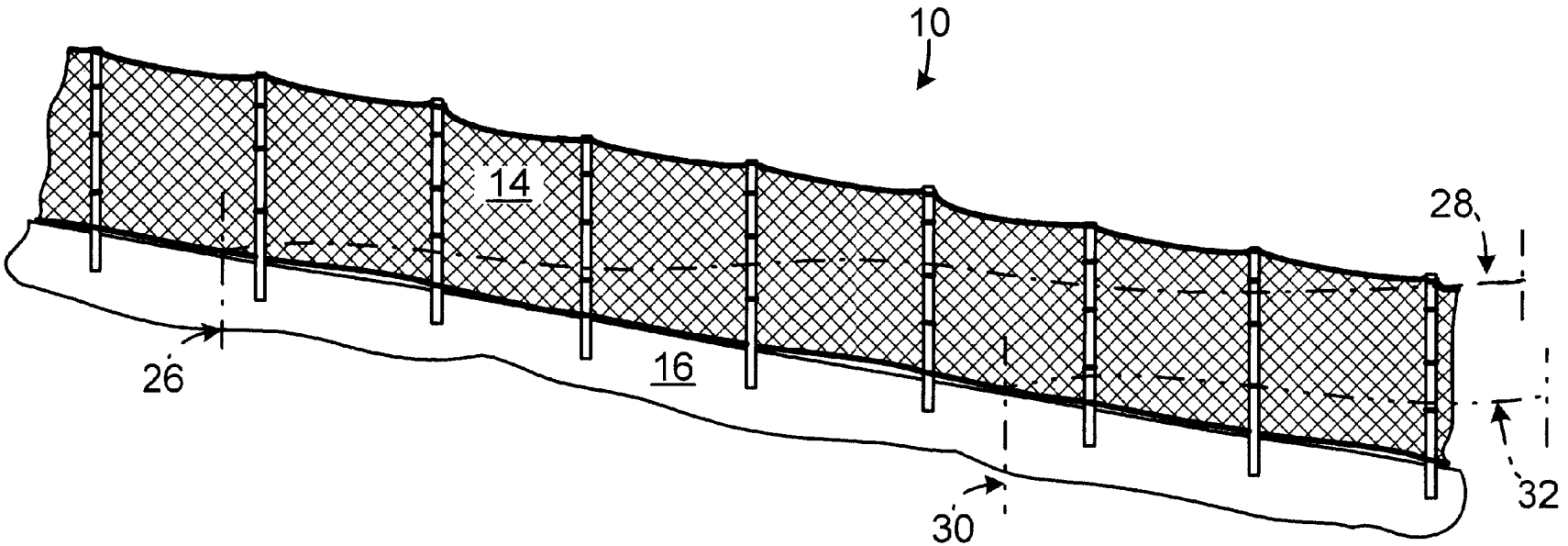
FIG. 2 is a side-perspective view of the apparatus for shoreline reclamation installed on the shoreline between the high tide and low tide water lines, with the compliant barrier extending into the water from the low tide water line.

FIG. 2 is a side-perspective view of the compliant porous groin 10 installed on a beach 14 with the groin 10 and barrier 14 extending between the high tide water line 26 and low tide water line 30. The beach 16 includes a beach portion that is not ordinarily covered with water, which extends up the beach from the high tide line 26. The beach portion may have a water flow across it during spring tides or storm events, and thus, it is advisable, but not necessary, to have the groin 10 extend onto the beach portion. There is a substantially water-covered portion of the beach, such as the inter-tidal region between the high tide line 26 and low tide line 30. The substantially-water covered portion is thus fully covered by water at high tide, as shown by high tide water line 28, and is uncovered at low tide as shown by low tide water line 32, and generally has some portion thereof covered with water in between high tide line 26 and low tide line 30. Below the low tide line 30 is the water portion of the beach that will experience a more constant eroding water flow. The supports 12 can be placed entirely in the substantially water-covered portion, i.e. between the high tide line 26 and low tide line 30. Or, the groin 10 can be placed with supports 12 extending from the substantially-water covered portion to the beach portion of the shoreline. Alternately, as shown in FIG. 2, the compliant porous groin 10 can extend completely from the water potion of the beach, i.e. below the low tide line 30, to the beach portion above the high tide line 26. It is desirous that the groin 10 be placed such that the barrier 14 is placed such that at least a portion thereof is in the water flow present at high tide, as shown by high tide water line 28, whereby the barrier 14 is constantly accreting sediment regardless of the changing of the tides.

Figure 3A:
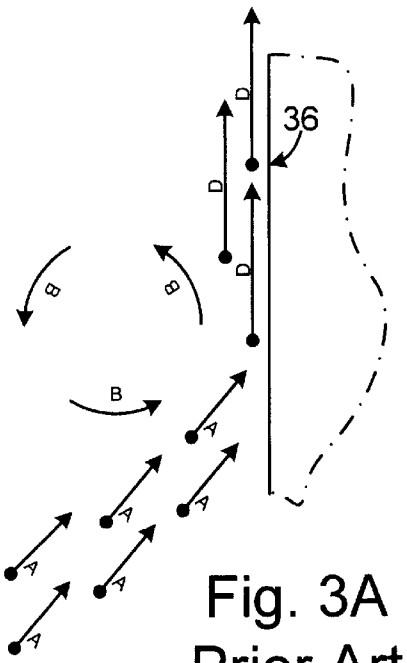
Fig. 3A Prior Art
FIG. 3A is an illustration of a prior art method of beach restoration with a sediment-laden water flow impacting against a planar, solid barrier such as a sea-wall, with the incoming water flow shown by vectors A, the post-impact deflected water flow shown by vectors D, and an area of turbulent flow shown by vectors B.
Figure 3B:
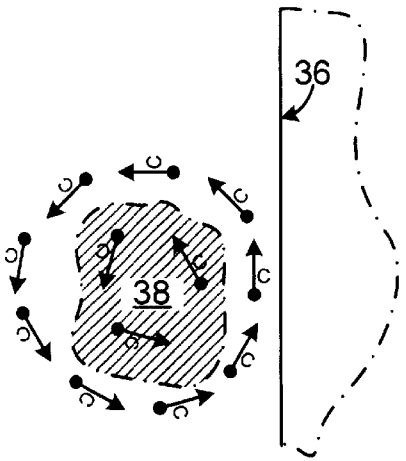
Fig. 3B Prior Art
FIG. 3B is a further illustration of the prior art method of FIG. 3A wherein the slowed turbulent water flow of vector C has a velocity less than the critical accretion velocity of the sediment-laden water causing an area of sediment accretion adjacent the sea-wall.
Figure 4A:
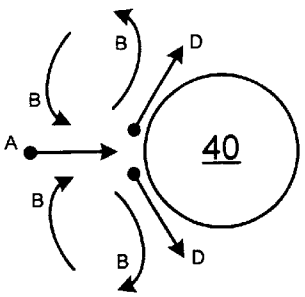
Fig. 4A Prior Art
FIG. 4A is an illustration of a prior art method of beach restoration with a sediment-laden water flow impacting against a fixed barrier such as slat of a slatted groin, a fence post, rail, or non-compliant wire or rope in a mesh, with the incoming water flow shown by vector A, the post-impact deflected water flow shown by vectors D, and areas of turbulent flow shown by vectors B.
Figure 4B:
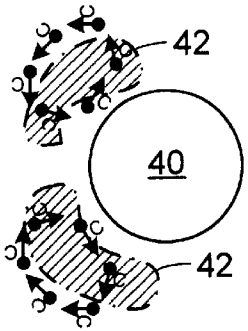
Fig. 4B Prior Art
FIG. 4B is a further illustration of the prior art method of FIG. 4A wherein the slowed turbulent water flow of vector C has a velocity less than the critical accretion velocity of the sediment-laden water causing an area of sediment accretion adjacent the fixed barrier.
Figure 5A:
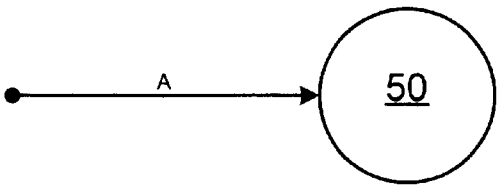
FIG. 5A is an illustration of a body of the compliant barrier of the present invention in a sediment-laden water flow with the incoming water flow shown by vector A initially encountering the body of the compliant barrier.
Figure 5B:
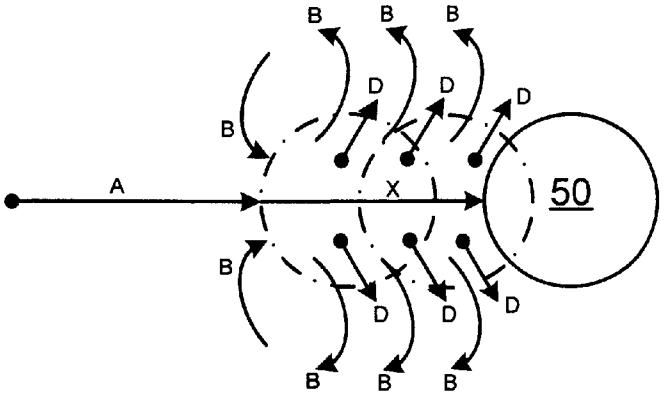
FIG. 5B is an illustration of the body of the compliant barrier of FIG. 5A wherein the compliance of the barrier is shown by vector X, the post-impact deflected water flow shown by vectors D, and areas of turbulent flow shown by vectors B.
Figure 5C:
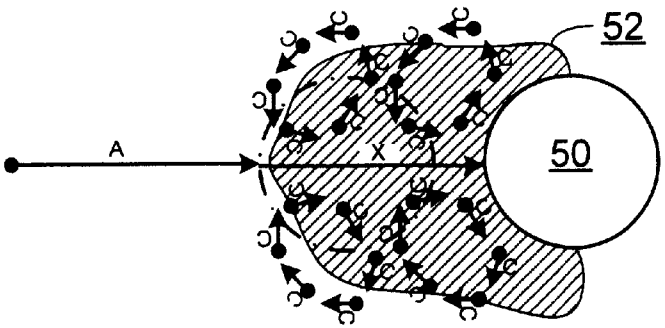
FIG. 5C is a further illustration of the sediment-laden water flow of FIG. 5A wherein the slowed turbulent water flow of vectors C has a velocity less than the critical accretion velocity of the sediment-laden water causing an area of sediment accretion adjacent the body of the compliant barrier.

The advantage of the compliance of the barrier 14 in accreting sediment from the water flow is illustrated by contrasting the prior art FIGS. 3A–4B with the present invention of FIG. 5A–5C. The present invention takes advantage of the superior sediment accretion performance from the movement of the solid portions of the barrier, such as a string of the net, when impacted with sediment-laden water. The erosive water flow has sediments taken from the flow across the shoreline, such as sand, suspended therein and will keep the sediment suspended therein as long as the water flow maintains a velocity above a critical accretion velocity. If the velocity of the water flow is slowed below the critical accretion velocity due to any reason, such as impact with an object or in an area of turbulence adjacent to the solid object, the sediment will accrete from the water flow. It is known in the art that interrupting the erosive water flow with solid objects, such as jetties, will cause the accretion of the sediment. However, the full interruption of the erosive water flow will also alter the natural current flow across the shoreline and causes adverse erosion of shoreline in other locations.

In FIGS. 3A–3B, the prior art use of a sea wall 36, such as a jetty, to impede the progress of erosive water flow is shown. Adjacent to a shoreline, the erosive water flow is comprised of a long shore transport current parallel to the shoreline and periodic waves traveling within the fluid body. The wave action represents a transient fluid velocity that is superimposed upon the average fluid flow velocity, or long shore transport current, of the body of water adjacent to the shore. In FIG. 3A, Vectors A represent a portion of a wave impacting the face of the sea wall 36. Applying basic continuity principles of fluid flow and ignoring any compressibility effects, the volume of fluid impacting the sea wall face at any given increment of time due to the wave action must equal the volume of fluid traveling down the face and reflected from the seawall. In FIG. 3A, the leading edge of the wave has impacted the sea wall 36 and Vectors D represent a portion of the fluid volume traveling down the face of the sea wall 36 and Vectors B represent a reflected turbulent portion of the original fluid volume. The velocity vector D of FIG. 3A is typically higher than the original wave velocity represented by Vector A of FIG. 3A.

It is thus seen that a portion of the fluid flow (vectors D) actually accelerates across the face of the sea wall 36 which can cause serious erosive effects immediately adjacent to the sea wall 36. Such erosion occurring over a period of time often undermines the foundation integrity of a body placed in the erosive water flow. However, the sea wall 36 does accrete sand in that a region of turbulence occurring between the average fluid of the wave (vectors A) and the faster moving water traveling down the face of the seawall (vectors D). As shown in FIG. 3A, the turbulent flow region, represented by vectors B, typically occurs as a swirl in the fluid medium forming on the trailing edge of the passing wave and adjacent the sea wall. Typically, the turbulent region (vectors B) forms continuously along the face of the sea wall 36 as adjacent turbulent cells of swirling fluid in the wake of the impacting wave. After the wave passes, the fluid velocity within each turbulent cell begins to slow. As shown in FIG. 3B, the swirling fluid gradually losses energy to reach a critical accretion velocity, shown here as vectors C, such that the water will begin to accrete any sediment contained therein at the time the vector C is attained. Consequently, the accretion zone 38 for sediment accreting from the slowed water is away from the face of the sea wall 36 and is generally a small area in comparison to the entire surface area of sea bed because the accretion zone 38 will only occur at areas of turbulence.

In the prior art FIGS. 4A and 4B, there is shown a rigid body 40 generally circular in cross section, such as a pole, stanchion, or wire being placed into the erosive water flow. As a wave impacts the body 40 in FIG. 4A, the water velocity adjacent the body increases as the wave travels around the obstacle. In FIG. 4A, the wave velocity is shown by vector A and the velocity of the water adjacent the body by vectors D. As with the sea wall of FIGS. 3A and 3B, turbulent regions represented by vectors B will form between the impacting fluid flow (vector A) and the higher velocity fluid (vectors D) adjacent the body. As shown in FIG. 4B, after the wave passes the swirling fluid will slow to attain the critical accretion velocity (vectors C) in the region of turbulence. Thus, as shown in FIG. 4B, accretion zones 42 will form outward from the body 40 in the areas of turbulence.

In contrast as shown in FIGS. 5A–5C, the inventive compliant porous groin 10 has the solid portions of the barrier compliant at the point of impact of the wave and lessens the velocity (vector A) of the fluid deflecting off the barrier to aid the sand accretion. In FIG. 5A, the wave is beginning to impact a compliant body 50, which could be an elastic body, such as a string portion of a net or a section of an interwoven member, or the compliant body 50 may be a rigid body that is flexibly attached to the supports 12. As shown in FIG. 5B, the compliant body 50 moves in response to the impact of the wave. For purposes of illustration, the compliant body 50 is shown as having moved rearward a distance, represented by vector X, in response to the impact of the wave in a particular direction (vector A). During the movement of the compliant body 50 from the starting position at impact of the wave, the deflecting water flow (vectors D) is imparted with a lower velocity than would be attained from impacting a rigid barrier. The lower velocity (vectors D) lessens the erosion that would otherwise occur adjacent to the body. As with the rigid body of FIG. 4A and 4B, a turbulent region (vectors B) will form adjacent the body between the impacting water flow (vector A) and the deflecting water (vectors D). As shown in FIG. 5C, after the wave passes the turbulent fluid will slow to attain the critical accretion velocity (vectors C) in the region of turbulence. The reduced velocity of the deflected water flow (vectors D) results in the turbulent fluid having less energy than that imparted by impacting a rigid body. A portion of the deflected water flow is immediately slowed to the critical accretion velocity by impacting the compliant barrier. The resultant turbulent fluid of the compliant body 50 slows to the critical accretion velocity more quickly which results in a higher sand accretion rate than that of a rigid body. Additionally, the movement of the compliant body 50 over the distance (vector X) results in a larger area of turbulent flow. Thus an enlarged accretion zone 52, shown in FIG. 5C, will form outward from the body 50 in the enlarged areas of turbulence.

The illustration shows that, proportional to the fixed and rigid bodies of FIGS. 4A–4B, the compliant body 50 can improve the accretion rate, and effect a far greater accretion zone through the lower deflected fluid velocity in contrast to the higher deflected fluid velocity caused at impact with the rigid sea wall 36 in FIGS. 3A–3B and the rigid body 40 in FIGS. 4A–4B.

Consequently, the barrier 14 is comprised of solid bodies not rigidly affixed in the water flow, such as the strings of a net or solid portions of an otherwise porous barrier, and the actual compliance of the barrier can be adjusted such that the deflecting water flow velocity (vector D in FIG. 5B) is reduced and the rate of sand accretion, and size of the sand accretion zone 52 are maximized. Further, the porosity of the net can also be varied to increase or decrease overall resistance of the barrier within the water flow. It is preferred, but not necessary, that porosity be greater than 50% of area on the barrier because lower porosity significantly interferes with the water flow and increases the force load on the barrier 14 and supports 12. Moreover, the compliant body 50 cannot be infinitely compliant and will thus give some resistive force to the water flow, especially as the full elastic limit is approached for whatever compliant method is used in the groin 10, such as an elastic barrier 14 or a rigid barrier 14 flexibly attached to the supports 12.

Figure 6A:
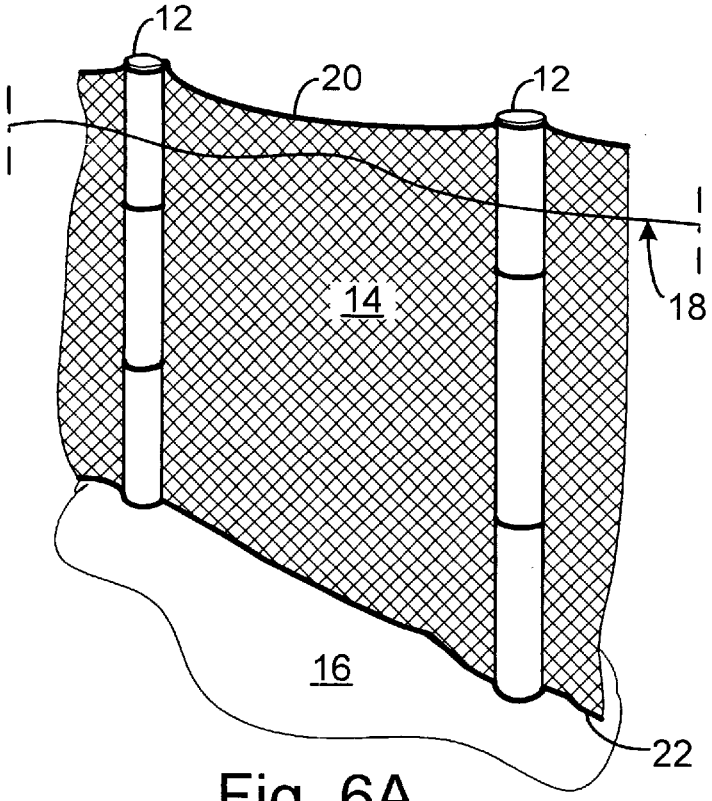
FIG. 6A is a perspective view of a section of the beach restoration apparatus installed on a shoreline with the compliant porous barrier partly within the water.
Figure 6B:
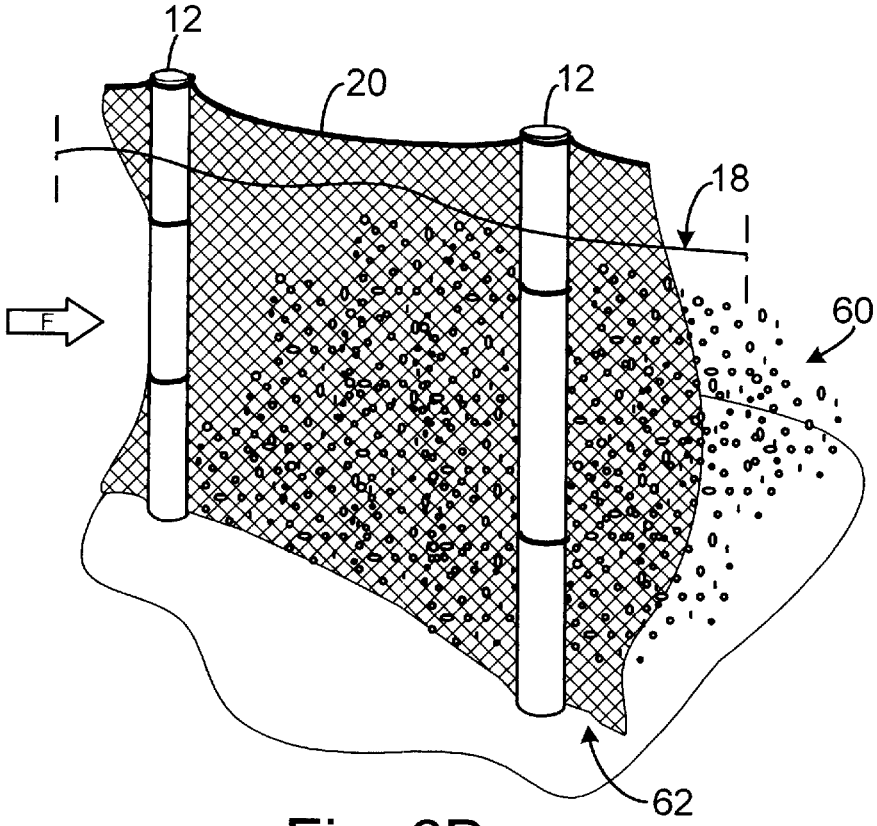
FIG. 6B is the beach restoration apparatus of FIG. 6A with a sediment-laden water flow in the direction of Arrow F through the complaint porous barrier, and the barrier is causing sediment to accrete from the water flow onto the sea bottom.

In operation, as shown in FIGS. 6A and 6B, the barrier 14 is placed in water, preferably such that a portion of the barrier 14 is above the water line 18 so that the groin 10 is visible and does not pose a water hazard. The barrier 14 is also placed in the water preferably such that the barrier 14 is generally perpendicular to the direction of the main erosive water flow, which in a coastal shoreline, is typically the longshore transport, but the barrier 14 will also work with non-orthogonal water flows. In FIG. 6B, once the sediment-laden water flow begins to flow through at least a portion of the barrier 14, the water flow shown in the direction of Arrow F, the barrier 14 begins to cause the accretion of the sediment suspended in the water, as shown by the accreting sediment 60. The accreting sediment 60 also can cover the bottom edge of the barrier 14, such as weighted bottom edge 22, such that there is a covered lower edge 62 of the barrier 14. The barrier 14 should thus be occasionally pulled out of the accreting sediment 60 such that the covered bottom edge 62 does not become too buried within the accreting sediment whereby extreme force must be used to extract the barrier 14. As long as the barrier 14 is periodically raised, the entire groin 10 can be easily removed from the shoreline by detaching the barrier 14 from the supports and removing same, and then extracting the supports 12 from the beach.

As shown in FIGS. 1, 2 and 6A–6B, the use of the porous groin 10 thus provides a method for restoring a shoreline that has a eroding water flow moving at an velocity thereacross, which includes the steps of placing at least two supports 12 in the eroding shoreline (such as beach 16), attaching a compliant porous barrier 14 to the at least two supports 12 such that the barrier is at least partially within the water flow of the shoreline and the water flow passes through at least a portion of the barrier, as shown in FIGS. 6A–6B, and accreting sediment from the water flow with the compliance of the barrier 14 slowing the water flow impacting the barrier 14 to at least the critical accretion velocity, as shown in FIG. 6B. The method can include the step of lifting the barrier 14 out from the accreting sediment 60 as sediment accretes from the water flow to cover the barrier 14, as shown by covered lower edge 62 in FIG. 6B. The method also preferably includes the step of removing the barrier 14 and at least two supports 12 from the shoreline once the shoreline is renourished, thus reflecting the temporary nature of use of the compliant porous groin 10 to restore the shoreline.

The step of placing at least two supports 12 in the eroding shoreline can be placing at least two supports 12 are entirely in the substantially water-covered portion of the shoreline, i.e. between the high tide line 26 and the low tide line 30, or entirely in the water beneath the low tide line 30. Otherwise, at least one support 12 can be placed in the beach portion, i.e. above the high tide line 26, and at least one support 12 can be in the substantially water-covered portion, i.e. below the high tide line 26.

As shown in FIGS. 1, 2 and 6A–6B, the step of attaching a compliant porous barrier 14 to the at least two supports 12 can be attaching a rigid porous barrier 14 to the at least two supports 12 such that the barrier is flexibly held to the at least two supports 12, such as with flexible fasteners similar to bands 24. In such embodiment, the step of accreting sediment from the water flow impacting the barrier 14 is accreting sediment from the water flow impacting the rigid barrier 14 made compliant to the impacting water flow from the flexible attachment to the at least two supports 12, with the compliance of the rigid barrier slowing the impacting water flow to at least the critical accretion velocity, as illustrated in FIGS. 5A–5C. Alternately, the step of attaching a compliant porous barrier 14 to the at least two supports 12 can attaching an elastic porous barrier 14, such as the mesh in FIG. 1, to the at least two supports 12, and the step of accreting sediment from the water flow impacting the barrier 14 is accreting sediment from the water flow impacting the elastic barrier 14 that is compliant to the impacting water flow from the elasticity of the barrier 14, the compliance of the elastic barrier slowing the impacting water flow to at least the critical accretion velocity.

While there has been shown a preferred embodiment of the present invention, it is to be understood that certain changes may be made in the forms and arrangement of the elements of the flexible porous groin and steps of the method for shoreline reclamation without departing from the underlying spirit and scope of the invention. Moreover, the description of the preferred embodiment above is not intended to imply any specific definition to the terms of the claims unless expressly stated to the contrary.

What is claimed is:

1. A compliant porous groin for restoring an eroding shoreline, the shoreline having a eroding water flow moving at an velocity thereacross, and the water flow including suspended sediments therein and having a critical accretion velocity wherein the suspended sediments will accrete from the water flow if the velocity of water flow is less than the critical accretion velocity, the compliant porous groin comprising:

at least two supports placed in an eroding shoreline; and an adjustably compliant porous barrier attached to the at least two supports such that the barrier is at least partially within the water flow of the shoreline and the water flow passes through at least a portion of the barrier, and wherein the barrier is compliant such that the water flow impacting the barrier is slowed to at least the critical accretion velocity.

2. The porous groin of claim 1, wherein the shoreline includes a beach portion and a substantially water-covered portion, and the at least two supports are placed entirely in the substantially water-covered portion.

3. The porous groin of claim 1, wherein the shoreline includes a beach portion and a substantially water-covered portion, and the at least two supports are placed such that at least one support is in the beach portion, and at least one support is in the substantially water-covered portion.

4. The porous groin of claim 1, wherein the barrier is made of a rigid material and flexibly held to the support to be compliant to the impacting eroding water flow.

5. The porous groin of claim 4, wherein the rigid material is rigid plastic webbing.

6. The porous groin of claim 4, wherein the rigid material is a wire-mesh.

7. The porous groin of claim 1, wherein the barrier is made of an elastic material compliant to the impacting eroding water flow.

8. The porous groin of claim 7, wherein the elastic material is semi-rigid plastic webbing.

9. The porous groin of claim 7, wherein the elastic material is a mesh.

10. The porous groin of claim 1, wherein at least one of the two supports is a stanchion.

11. The porous groin of claim 1, wherein at least one of the two supports is a tripod.

12. The porous groin of claim 1, wherein at least one of the two supports is a channel.

13. The porous groin of claim 1, wherein the barrier is formed of an interwoven series of members.

14. An apparatus for restoring an eroding shoreline, the shoreline having a eroding water flow moving at a velocity thereacross, and the water flow including suspended sediments therein and having a critical accretion velocity wherein if the velocity of the water flow is less than the critical accretion velocity, the suspended sediments accrete from the water flow, the apparatus comprising:

a support means for supporting a compliant porous barrier in an eroding shoreline; and a barrier means for causing the water flow impacting the barrier means to be slowed to at least the critical accretion velocity, the barrier means comprised of an adjustably compliant porous barrier attached to the support means such that the barrier means is at least partially within the water flow of the shoreline and the water flow passes through at least a portion of the barrier means.

15. A method for restoring a shoreline having a eroding water flow moving at an velocity thereacross, and the water flow including suspended sediments therein and having a critical accretion velocity wherein the suspended sediments accrete from the water flow if the velocity of water flow is less than the critical accretion velocity, the method comprising the steps of:

placing at least two supports in the eroding shoreline;

attaching an adjustably compliant porous barrier to the at least two supports such that the barrier is at least partially within the water flow of the shoreline and the water flow passes through at least a portion of the barrier; and accreting sediment from the water flow with the compliance of the barrier slowing the water flow impacting the barrier to at least the critical accretion velocity.

16. The method of claim 15, further comprising the step of lifting the barrier out from the accreting sediment from the water flow as the accreting sediment covers the lower portion of the barrier.

17. The method of claim 15, wherein the shoreline includes a beach portion and a substantially water-covered portion, and the step of placing at least two supports in the eroding shoreline is placing at least two supports are entirely in the substantially water-covered portion of the shoreline.

18. The method of claim 15, wherein the shoreline includes a beach portion and a substantially water-covered portion, and the step of placing at least two supports in the eroding shoreline is placing the two supports in the eroding shoreline such that at least one support is in the beach portion, and at least one support is in the substantially water-covered portion.

19. The method of claim 15, wherein:

the step of attaching a compliant porous barrier to the at least two supports is attaching a rigid porous barrier to the at least two supports such that the barrier is flexibly held to the at least two supports; and the step of accreting sediment from the water flow impacting the barrier is accreting sediment from the water flow impacting the rigid barrier made compliant to the impacting water flow from the flexible attached to the at least two supports, the compliance of the rigid barrier slowing the impacting water flow to at least the critical accretion velocity.

20. The method of claim 15, wherein:

the step of attaching a compliant porous barrier to the at least two supports is attaching an elastic porous barrier to the at least two supports; and the step of accreting sediment from the water flow impacting the barrier is accreting sediment from the water flow impacting the elastic barrier that is compliant to the impacting water flow from the elasticity of the barrier, the compliance of the elastic barrier slowing the impacting water flow to at least the critical accretion velocity.

21. The method of claim 15, further comprising the step of removing the barrier and at least two supports from the shoreline.

22. A method for restoring a shoreline having a eroding water flow moving at a velocity thereacross, and the water flow including suspended sediments therein and having a critical accretion velocity wherein the suspended sediments accrete from the water flow if the velocity of water flow is less than the critical accretion velocity, the method comprising the steps of:

a support placement step for placing at least two supports in the eroding shoreline;

a barrier attachment step for attaching an adjustably compliant porous barrier to the at least two supports such that the barrier is at least partially within the water flow of the shoreline and the water flow passes through at least a portion of the barrier; and a sediment accretion step for accreting sediment from the water flow with the compliance of the barrier slowing the water flow impacting the barrier to at least the critical accretion velocity.

23. The method of claim 22, further comprising a barrier lifting step for lifting the barrier out from the accreting sediment as sediment accretes from the water flow to cover the lower portion of the barrier.

24. The method of claim 22, further comprising a removal step for removing the barrier and at least two supports from the shoreline.

* * * * *